US012168910B2

(12) United States Patent
Rege

(10) Patent No.: US 12,168,910 B2
(45) Date of Patent: Dec. 17, 2024

(54) METHOD AND APPARATUS FOR PLUGGING

(71) Applicant: Wellstrøm AS, Ræge (NO)

(72) Inventor: Gert Olav Rege, Raege (NO)

(73) Assignee: Wellstrøm AS, Raege (NO)

( * ) Notice: Subject to any disclaimer, the term of this patent is extended or adjusted under 35 U.S.C. 154(b) by 0 days.

(21) Appl. No.: 17/919,960

(22) PCT Filed: Feb. 23, 2021

(86) PCT No.: PCT/NO2021/050047

§ 371 (c)(1),
(2) Date: Oct. 19, 2022

(87) PCT Pub. No.: WO2021/221513

PCT Pub. Date: Nov. 4, 2021

(65) Prior Publication Data

US 2023/0160277 A1 May 25, 2023

Related U.S. Application Data

(60) Provisional application No. 63/017,676, filed on Apr. 30, 2020.

(51) Int. Cl.
*E21B 33/134* (2006.01)
*E21B 29/02* (2006.01)
(Continued)

(52) U.S. Cl.
CPC ..... *E21B 33/134* (2013.01); *E21B 29/02* (2013.01); *E21B 36/008* (2013.01); *E21B 43/1193* (2020.05)

(58) Field of Classification Search
CPC ... E21B 33/134; E21B 36/008; E21B 43/1193
See application file for complete search history.

(56) References Cited

U.S. PATENT DOCUMENTS 7,290,609 B2 * 11/2007 Wardlaw ..... E21B 33/134 166/387
10,760,374 B2 * 9/2020 Hearn ..... H10B 43/40
(Continued)

FOREIGN PATENT DOCUMENTS

EP 2513416 A2 10/2012
WO WO-2011073610 A2 6/2011
(Continued)

OTHER PUBLICATIONS

Solomon, Sirak; International Search Report; PCT/No. 2021/050047; Dated May 20, 2021; 3 pages.

*Primary Examiner* — Brad Harcourt
(74) *Attorney, Agent, or Firm* — Bradley Arant Boult Cummings LLP

(57) ABSTRACT

A method and apparatus for sealing a well conduit includes moving a plugging tool (21) to a first position in the well conduit, the plugging tool (21) comprising a perforating tool (12) and a hollow mandrel (8) with a heater (8) inside and a meltable material on the outside. The perforating tool (12) is actuated to create openings in the well conduit. The heater (8) is operated to melt or activate the material disposed on an exterior of the mandrel (9). The melted material is allowed to solidify in the conduit to form a plug and to flow into the openings to fill a cross-section of an annular space outside the conduit. A logging tool (2) may thereafter be inserted into the hollow mandrel (9) to check the integrity of the plug.

20 Claims, 7 Drawing Sheets

(51) Int. Cl.
*E21B 36/00* (2006.01)
*E21B 43/119* (2006.01)

(56) References Cited

U.S. PATENT DOCUMENTS

| | | | | |
|---|---|---|---|---|
| 2002/0162657 | A1* | 11/2002 | Tumlin | E21B 43/11855 166/117.6 |
| 2006/0048940 | A1* | 3/2006 | Hromas | E21B 43/116 166/55 |
| 2006/0144591 | A1* | 7/2006 | Gonzalez | E21B 29/10 166/57 |
| 2008/0047708 | A1 | 2/2008 | Spencer | |
| 2013/0087335 | A1 | 4/2013 | Carragher et al. | |
| 2018/0066489 | A1* | 3/2018 | Pipchuk | E21B 36/04 |
| 2018/0148991 | A1 | 5/2018 | Hearn et al. | |
| 2018/0252069 | A1* | 9/2018 | Abdollah | E21B 33/13 |
| 2018/0298720 | A1 | 10/2018 | Billingham et al. | |
| 2019/0128092 | A1 | 5/2019 | Mueller et al. | |
| 2019/0186233 | A1 | 6/2019 | Shafer | |

FOREIGN PATENT DOCUMENTS

| | | | | |
|---|---|---|---|---|
| WO | WO-2016049424 | A1 | 3/2016 | |
| WO | WO-201908960 | A1 | 1/2019 | |
| WO | WO-2019089608 | A1 * | 5/2019 | E21B 29/002 |
| WO | WO-2019151870 | A1 | 8/2019 | |

* cited by examiner

METHOD AND APPARATUS FOR PLUGGING

TECHNICAL FIELD

This disclosure relates to the field of plugging a well (petroleum, water, geothermal or otherwise) permanently or temporarily. More specifically, the disclosure concerns a tool and a method for plugging a subterranean well permanently or temporarily, for instance, during a plug and abandonment operation (P&A) or during other operations where the setting of a barrier in the well is required As many oil and gas fields are rapidly declining and nearing the end of their productive lives, methods known in the art for permanently abandoning wells have been often looked to existing drilling technologies. This approach has worked for the small number of wells so far abandoned but the current methods are often time and labor intensive and prohibitively expensive if required to be carried out on a large number of wells. As the number of full offshore fields to be abandoned is rising, a different solution is required to ensure wells are correctly abandoned meeting all of the health, safety and environmental standards applicable.

BACKGROUND ART

Current methods of well abandonment typically require the production tubing through which produced fluids flow to be pulled from the well before the job of setting abandonment cement plugs can be performed. The integrity of the outer casing annulus is then assessed which may also require repair. Typically, this requires the job of milling through casing to access an annulus behind casing and then placing cement in the area. Such methods usually require an expensive drilling rig or workover unit and are increasingly impractical if multiple casings are involved.

Other methods in the state of the art have tried to avoid either the pulling of the production tubing or the milling of the outer casing to access the annuli to be isolated by perforating either the tubing or outer casing. Cement is then circulated or squeezed via the perforations to isolate the annulus. However, this method has a number of disadvantages. Cement is a notoriously difficult material to ensure the quality of, particularly in a downhole environment. Much evidence has shown that wells with apparently cemented annuli have in fact lacked suitable isolation due to poor placement or cement quality. Furthermore, many wells the wells that have had well-cemented annuli later develop micro annuli, cement deterioration and poor cement-steel bonding resulting in the cement leaking and not maintaining a functional pressure seal.

The placement and coverage of cement is also difficult to determine and often several attempts are required to successfully seal an annulus.

The company Rawwater engineering Company Ltd. has several good solutions to the above problems.

EP2513416, which is incorporated herein by reference, describes a method and apparatus for plugging a wellbore. The apparatus comprises a carrier having placed on its outer side a material with a melting point lower than that of the wellbore, such as an allot with a high proportion of bismuth. Inside the carrier is a heater, which may be electric. Below the carrier is a hollow skirt.

As the heater melts the material on the outside of the carrier, it melts and runs down to the skirt where it cools and solidifies. As material builds up on the skirt it will seal the wellbore and form a plug. When the plug material has solidified completely, the heater is disengaged from the carrier and retrieved.

It has been known that plugs of the above type may not seal properly, and it is therefore important to ensure that the plug been properly melted and solidified and that it has a good seal with the wellbore. In WO2019/089608, which also describes a plug setting apparatus for installing a bismuth plug, has addressed this issue. After the plug has been set, a hole is drilled into the plug and a logging tool, such as a sonic unit, is lowered into the plug to check the integrity of the plug.

This method has a number of disadvantages. It requires an extra trip into the well, as a drilling tool has to be lowered down to the plug and retrieved again before the logging tool can be used. Moreover, it is difficult to accurately drill a hole into the plug; it may be placed off-center and may be drilled too short or to far. It the plug is completely penetrated, the plug itself has to be plugged. The drilling may also compromise the integrity of the plug.

Consequently, there is a need for a method by which the integrity of the plug may be checked without any risk of damage to the plug, and with minimum extra efforts.

SUMMARY OF INVENTION

One aspect of the present disclosure is a method for sealing a well conduit. A method according to this aspect of the disclosure includes moving a plugging tool to a first position in the well conduit, the plugging tool comprising a perforating tool and a heater conveyed inside a hollow mandrel clad with a thermally activated material or alloy. The perforating tool is actuated to create openings in the well conduit. The heater device is operated to melt a material disposed on an exterior or interior of the plugging tool. The heater may then be recovered from inside the hollow mandrel. The melted material is then allowed to solidify in the conduit recipient volume to form a plug and to flow into the openings to fill a cross-section of an annular space outside the conduit. A logging tool may then be run inside the hollow mandrel, which has an internal diameter sufficiently large to accommodate the logging tool, to verify the status of the solidified material. The hollow mandrel may then later be filled with further plugging material, if desired.

In some embodiments, the plugging tool further comprises a depth correlation device and the moving comprises locating a feature using the depth correlation device.

In some embodiments, the depth correlation device comprises a magnetic casing collar locator.

In some embodiments, the creating openings comprises actuating explosive shaped charges.

In some embodiments, the material comprises a fusible metal alloy.

In some embodiments, the metal alloy comprises a mixture of bismuth and tin.

In some embodiments, the perforating tool is disconnected from the plugging tool and allowed to drop in the well conduit.

In some embodiments, the operating the heater/thermally activated material tool comprises initiating a pyrotechnic chemical reaction.

In some embodiments, the operating the heater/thermally activated material tool comprises operating an electric heater.

In some embodiments, the heater is disconnected from the hollow mandrel and recovered to surface.

A well conduit plugging tool according to another aspect of this disclosure includes a heater hollow mandrel inside which the heater is conveyed, a well conduit perforator connected to the heater/mandrel and a thermally activated plugging material clad on the hollow mandrel proximate to the heater and carried by the well conduit plugging tool for conveyance into a well conduit.

In some embodiments, the heater comprises a pyrotechnic chemical.

In some embodiments, the heater comprises an electric heater.

In some embodiments, the thermally activated plugging materials comprises a fusible metal alloy.

In some embodiments, the fusible metal alloy comprises a mixture of tin and bismuth.

In some embodiments, the thermally activated plugging material is disposed on an exterior of the hollow mandrel.

In some embodiments, the well conduit perforator comprises an explosive shaped charge perforator.

Other aspects and possible advantages will be apparent from the description and claims that follow.

DETAILED DESCRIPTION

Figure 1:
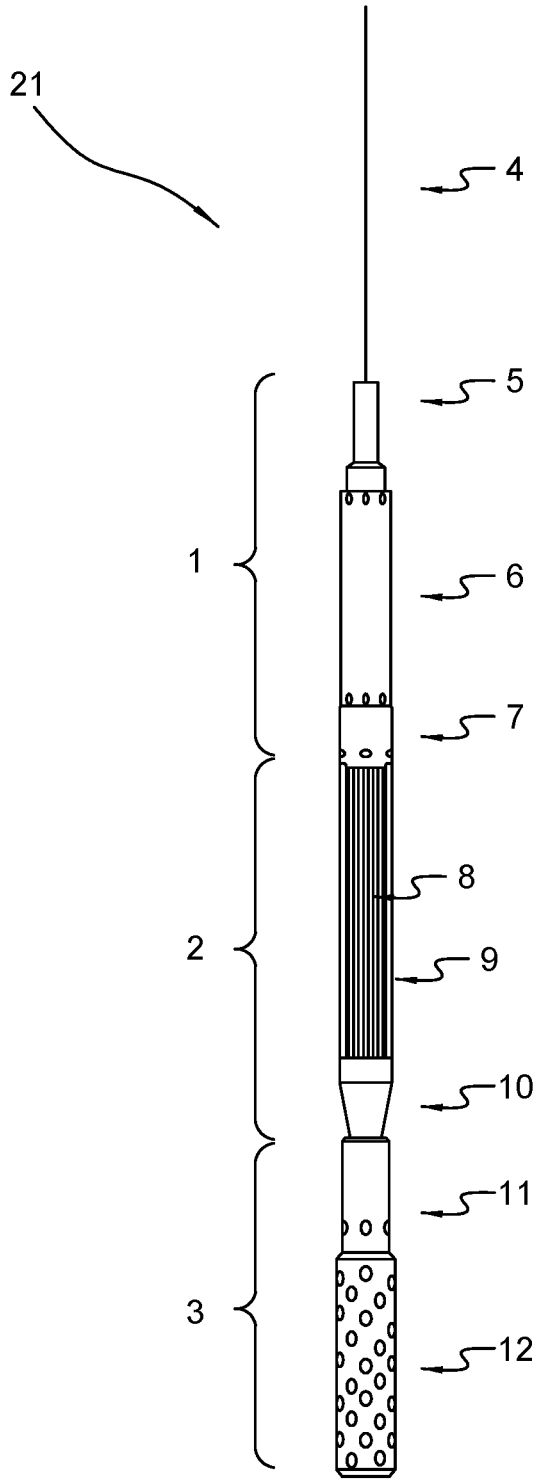
FIG. 1 shows an example embodiment of a plugging tool.

The present disclosure provides a plugging tool and method to allow wells to be plugged and abandoned in (1) a production tubing or (2) casing, in a single tool run into the well. This can be an efficient solution since the case of (1), the production tubing would not have to be removed and conventional cement plugs would not have to be set by running drill pipe or similar tubular into the well. Wells can be plugged entirely via means of electric wireline, coiled tubing or other light conveyance system, thus possibly removing the need for an expensive drilling rig or workover unit. In the case of (2), a rig or workover unit would still be needed to recover the production tubing from the well, however thereafter such a unit can be released since the tool can also be used to plug larger conduits using electric wireline or coiled tubing etc. Furthermore, being able to plug wells in a single run using thermally activated plugging materials or alloys are likely to be more efficient than existing techniques such as section milling or Perforate, Wash and Cement.

A plugging tool according to the present disclosure may combine three basic types of existing well intervention tools.

1. A depth correlation tool, such as a casing collar locator (CCL).
2. A combined heater, and thermally activated material sealing device. Thermite and pyrotechnical heater/alloy tools have been developed by a number of companies such as Rawwater Engineering Company Ltd., Isol8 and BiSN. Some embodiments may use pyrotechnic or other exothermal chemical reaction heating. An electrical heater may be used in some embodiments and can be sectioned into modules where heating can be activated for individual or all modules, it can accurately be controlled with respect to temperature accuracy, required temperature variations, heat-up and cool-down timing and much more. Furthermore, the heating process can be accurately monitored. A heating system may also be sectioned to heat the tubular it is deployed into prior to and after heating and placement of fusible alloys. Furthermore, other liquid sealing materials (such as geopolymers, resins or magneto-rheological cement for example) or other thermally activated materials may also be used.
3. Perforating technology, such as wireline conveyed perforators, thermite or fluid jet perforators, milling tools and the like.

A unique key aspect of the invention is that the plugging tool has a hollow mandrel. The heater is arranged inside the hollow mandrel and the mandrel is conveyed into the well with the heater inside. On the outside the mandrel is clad with the thermally-activated material. This design allows the heater to be recovered from the mandrel after the melting of the thermally-activated material. A logging tool can later be run inside the then unoccupied internal diameter of the mandrel to verify the status of the thermally-activated material following solidification.

The intention is that the above three intervention technologies can be combined into a single tool to be conveyed, for example, on electric wireline or coiled tubing with an electrical cable incorporated to perform the following operations.

Run the plugging tools either into a production tubing string or well casing. The tubing or casing may have been previously plugged below e.g. with a bridge plug and/or with an annular seal between the tubing and casing, e.g. a production packer. The depth correlation tool may be used to correlate depth with respect to the tubing pipe tally, and to axially locate, for example the position of the production packer (or tie-back seal stem or similar hardware) and a suitable area for perforating the production tubing.

Run a lower perforating section of the plugging tool to the desired depth (e.g., just above the production packer), again locating the correct axial position (depth) and the suitable area for perforation by using the depth correlation device.

Position and actuate the perforator to perforate the production tubing with relatively large diameter openings (e.g., about 0.45 in to 0.50 in diameter), without damaging the outer concentric casing. The perforating section of the plugging tool can be configured such that it can be either disconnected or dropped into the well after actuation or recovered if so desired.

Lower the plugging tool to position the combined heater, hollow mandrel and thermally activated material section of the plugging tool proximate the perforations. Activate the heater (which may generate heat by either electrical or chemical means such as thermite or pyrotechnic reaction) via the electric deployment/power cable. The heater will then generate sufficient heat such that an outer molten alloy cladding disposed on the exterior of the hollow mandrel will melt, or other liquid sealant will be activated. The molten alloy (or any or thermally activated liquid sealant used) will then flow as liquid through the perforations and into the annulus, solidifying as it cools and thereby creating a seal both inside the tubing and in the annulus. In some embodiments, the sealant material may be carried on the exterior surface of the hollow mandrel to facilitate its movement into the conduit and the space outside the conduit.

When the molten alloy (or liquid sealant) sealant material has flowed into the well and started to cool and solidify, it will ultimately form a solid abandonment plug across the full cross-section of the wellbore. Eutectic alloys or low melting-point alloys may be designed such that they cool relatively quickly, such as between 1 and 15 hours, when exposed to wellbore fluid and solidify almost instantaneously when they cool below their melting point, which in the case of a 52/48 alloy of bismuth and tin, occurs at 138° C. (other melting-point alloy mixes may be used depending on the expected temperature in the well). When the plugging tool is designed with a high thermal conductivity (e.g., steel) skirt which can act as a 'heat sink', the alloy will cool rapidly and solidify around the skirt, causing the alloy to build-up forming its own base and ultimately form a solid plug. Hence no base, 'umbrella' or 'petal basket' is required in the well to prevent the molten alloy from escaping. Furthermore, if thermite is used as a heat source, the by-products of this exothermic reaction can form an iron-like plug which also acts as a base upon which an alloy plug can form as the melted sealing material solidifies.

With a base or restriction thus formed in the tubing, the remaining molten alloy continues to flow under gravity and is deflected into the perforations and then into the annulus, where it later cools and solidifies, thereby forming a plug in the annulus. It should also be noted that other sealant displacement devices could be used while the alloy is still molten, such as using hydraulic pressure (hydraulic displacement) or kinetic energy (kinetic displacement) to inject the molten alloy into the annulus or indeed other recipient volumes. Hence a full plug can be formed in this manner across the full cross-section of the well.

When the sealing material has been displaced into the annulus or recipient volume and has solidified or begun to solidify, the heater can then be deactivated and disconnected from the hollow mandrel and recovered to the surface, leaving the hollow mandrel behind and set within the solidified thermally activated sealant. The perforation system is also left behind (which may already have fallen to the bottom of the well if configured to be released upon actuation). The internal diameter of the hollow mandrel can then be used as a conduit to accept logging tools that may then later be run to inspect and verify the status of the solidified plugging material and confirm the integrity of the newly installed plug.

The logging tool may be a sonic logging tool, such as a CBL (Cement Bond Log) tool or an ultra-sonic testing tool.

However, if the retention of the heater within the hollow mandrel section within the plug is later also deemed acceptable as a barrier, the plugging tool may instead be configured to also release the heater and leave it in the well inside the hollow mandrel. The heater may then be retrieved later when it is desired to use the hollow mandrel for insertion of a logging tool.

FIG. 1 shows an example embodiment of a plugging tool 21 according to the present disclosure. The plugging tool 21 may be conveyed inside a tubing or casing in the well and may be conveyed through the well using electric wireline, spoolable carbon rod, slickline or other conveyance and control devices (e.g. coiled tubing). The plugging tool 21 comprises three main sections, shown at 1, 2 and 3. Section 1 may be connected to section 2 via a disconnect mechanism 7, of types known in the art. Section 2 may be connected to section 3 through a firing head and disconnect mechanism 10 of types which are also known in the art. Section 3 may be referred to as a non-retrievable section, and the upper two sections 1 and 2 may be referred to as the retrievable sections, in that such sections (with the exception of the hollow mandrel 9) are intended to be withdrawn from the well after operation of the plugging tool 21 or not as the case may be. The plugging tool 21 may be connected to the wireline 4 or coiled tubing using a conventional cable head 5.

The plugging tool 21 comprises three modules, a depth correlation device 6, a combined hollow mandrel, heater and molten alloy (or thermally activated liquid sealant) device 2, and a perforating tool 12.

The depth correlation device 6 may be of types known in the art for depth control in wells having jointed tubulars. An existing example is a casing collar locator (CCL) which is a magnetic device used to tubing or casing collars (connections), joints, packers and centralisers, etc. that are present in or attached to well tubulars. The CCL detects changes in metal thickness as it moves through the well.

The CCL typically comprises a wire coil and magnet arrangement and may comprise a downhole amplifier. The most sensitive of these arrangements is two like-facing magnetic poles positioned on either side of a central coil. The magnetic lines of flux are distorted when the plugging tool 21 passes a location at which the metallic casing is enlarged by a collar. This distortion gives rise to a change in the magnetic field around the conducting coil, within which current is induced. The induced current signal is amplified and recorded at the surface in the form of a voltage spike known as a collar "kick." It should be understood depth correlation device 6 may comprise any device that can locate tubing components and provide depth control. It should also be understood that in some embodiments, the depth correlation device may be left out of the tool string if so desired.

The combined hollow mandrel, heater and molten alloy device 2 differs from types known in the art in that the heater 8 is encased within a hollow mandrel 9. The device 2 may comprise an electrical trigger activated by an electrical impulse or other signal conveyed from surface over an electric wireline or cable to initiate heating. The trigger may initiate a chemical reaction if a chemical reaction heater such as thermite or pyrotechnic is used, as in the case of some example embodiments. However, an electrical signal may also be used to switch on an electrical heating element if an electrical heater (not shown separately) is used. Possible advantages of the use of electric heaters are that they enable closer control of the heat output generated and also provide the possibility of measurement/feedback of the thermal environment downhole, allowing closer control and monitoring of alloy melt and indication of plug quality. Furthermore, the monitoring capability may allow a degree of verification of the seal following installation. The combined hollow mandrel, heater and molten alloy device 2 is referred to as such for convenience. It should be understood that the device 2 may be configured with any thermally activated material sealant and may in some embodiments be a heater/thermally activated sealant device. In some embodiments, as stated previously, a thermally activated sealing material may be carried or clad on the exterior of the heater/thermally activated material device 2 to facilitate movement into the well conduit and ultimately into a space external to such conduit.

The heat generated by the heater 8 then radiates out to the outer alloy cladding of hollow mandrel 9 which may be composed of a low melt-point eutectic alloy such as bismuth/tin (however other non-eutectic alloys and other thermally activated materials may be used in some embodiments). When heated to its melting point (e.g., 138 degrees Celsius for a 52/48 alloy of bismuth and tin), the alloy becomes molten and because of its high specific gravity (ca. 10 for a 52/48 alloy of bismuth and tin) and low viscosity (similar to that of water), the molten alloy readily flows down the outside of the plugging tool 21 and collects at a skirt 8 which acts as a heat sink. The molten alloy the cools very rapidly on the skirt 10 and starts to build up into a plug inside the production tubing or casing. This also prevents the molten alloy from escaping further down the well.

Provided sufficient alloy volume is conveyed by the plugging tool 21 and sufficient radial heat is generated by the heater, the molten alloy will be deflected by the plug forming around the skirt 10 and also readily flow (or be displaced by hydraulic or kinetic means) through the perforations in the production tubing or casing and into the annulus or recipient volume. Upon cooling the alloy will solidify and form a plug in the annular cavity.

It should be understood that the combined hollow mandrel, heater and molten alloy device 2 and skirt 10 shown in FIG. 1 may comprise any device that can deliver molten alloy sealant or other sealant in liquid or mobile form that is able to form a plug inside the production tubing or casing.

The firing head 12 and disconnect mechanism 11 may be activated or de-activated using a pre-programmed sequence of time, pressure/temperature safe windows and if required a series of pressure pulses and/or acceleration movements. The firing head is used to trigger the perforating tool 12 and release system connected below it.

It should be understood that the firing head 12 and disconnect mechanism 11 may comprise any device that can activate (and disconnect if so desired) the perforating tool 12.

The perforating tool 12 may comprise any perforating device that can perforate the tubing or casing in a controlled manner such that the outer casing wall in a well having nested tubing or inner casing is not deformed or otherwise damaged. The example shown is a tubing conveyed perforating (TCP) gun which is known in the art. The TCP gun comprises a hollow carrier that carries a series of explosive shaped charges mounted on a gun body inside the carrier. The shaped charges in the TCP gun are connected to the firing head by means of detonation cord. When triggered by electrical heating from the firing head or by actuation of a blasting cap, the detonation cord initiates the shaped charges which detonates the main explosive in the charges. The resulting explosive jet punches a hole in the tubular wall. A typical TCP gun system such as the one shown may be ca. 7 ft. long and may contain 12 charges per foot of gun length (but higher and lower shot densities are available) over a length of ca. 6 ft.

Figure 2:
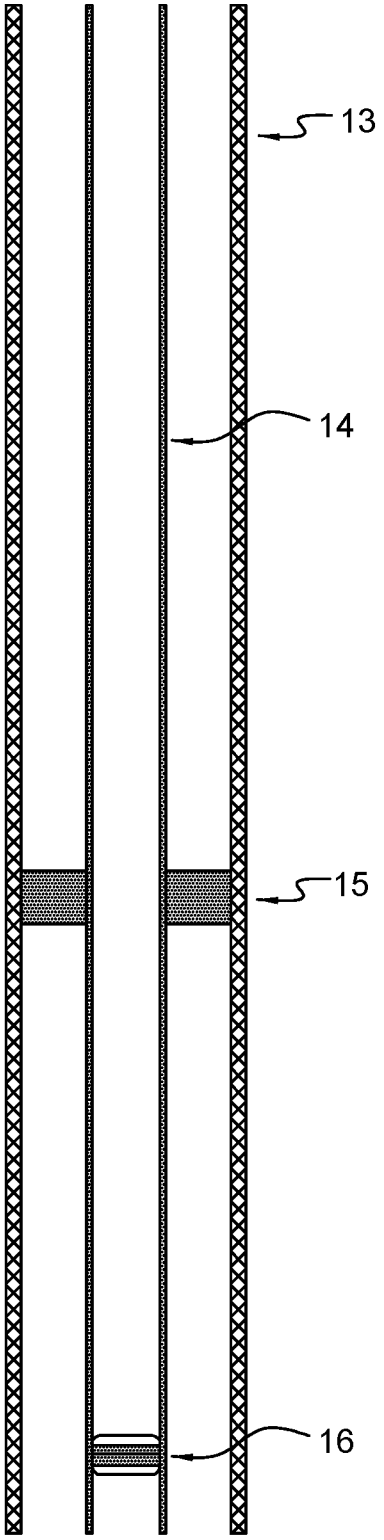
FIG. 2 shows a schematic drawing of a well prepared to be plugged by the plugging tool in FIG. 1.

FIG. 2 is the first of a series of schematic illustrations showing a possible sequence of operations of the plugging tool 21. It should be understood that FIG. 2 only shows a portion of the well, as the borehole and casing normally extend through formations above and below a target or reservoir formation and such tubulars are often connected to the terrain surface. It should also be understood that this terrain surface may be below a body of water (e.g., a seabed) or on dry land. The equipment and procedures used to run and operate downhole tools are well known in the art and will therefore not be described here.

Thus, in FIG. 2, the well comprises a production casing 13 and completion/production tubing 14 nested within the casing 13, both of which may extend into deeper formations. Such formations may contain mobile fluids (e.g., gas, oil, water, etc.). The casing may be for example a 9-⅝" diameter casing, and the tubing may be for example 4-½" diameter tubing, but the disclosure is not limited to these dimensions. The casing 13 may terminate at a depth below that shown in FIG. 2 and may be fixed to the surrounding formation using casing cement or other isolation material. The tubing 14 is connected to the casing inner wall using an annular seal such as a production packer 15. A bridge plug 16 is shown installed in the tubing 14. The well typically contains fluids (which may be drilling mud, completion fluid, water, oil, gas or other fluids etc.) and is ready to be plugged in the region above the production packer 15.

Figure 3:
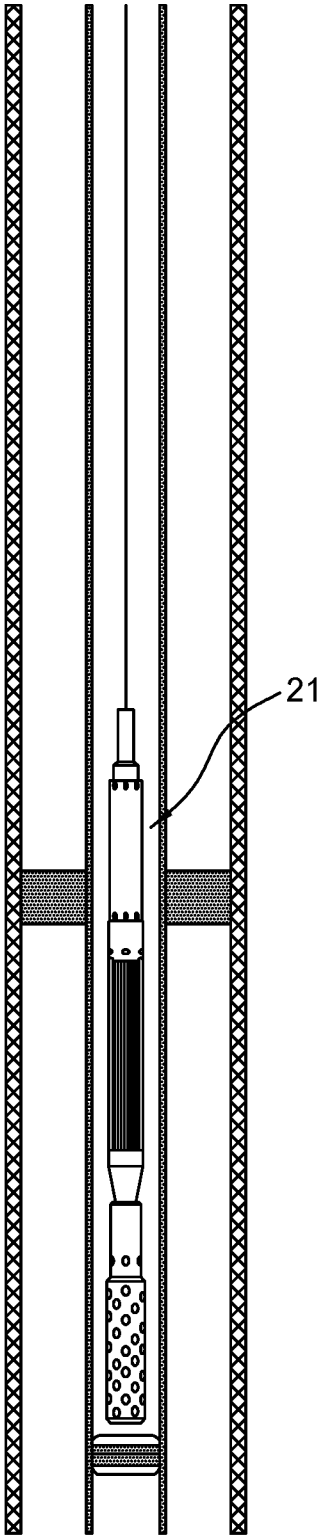
FIG. 3 shows a schematic drawing of a prepared well wherein the plugging tool has been run to the depth of the bridge plug and the CCL has detected the location of the production packer.

FIG. 3 shows an embodiment of the plugging tool 21 as it has entered the tubing 14 and run to the depth of the bridge plug 16. Although not illustrated, it should be understood that the plugging tool 21 may be conveyed down the tubing or casing (if the tubing is absent) and may be controlled from a surface location in a manner which is known in the art, e.g., using wireline 4 or coiled tubing. The depth correlation tool 6 is used to determine the depth of the plugging tool 21 relative to the tubing 14 and the position of the production packer 15.

Figure 4:
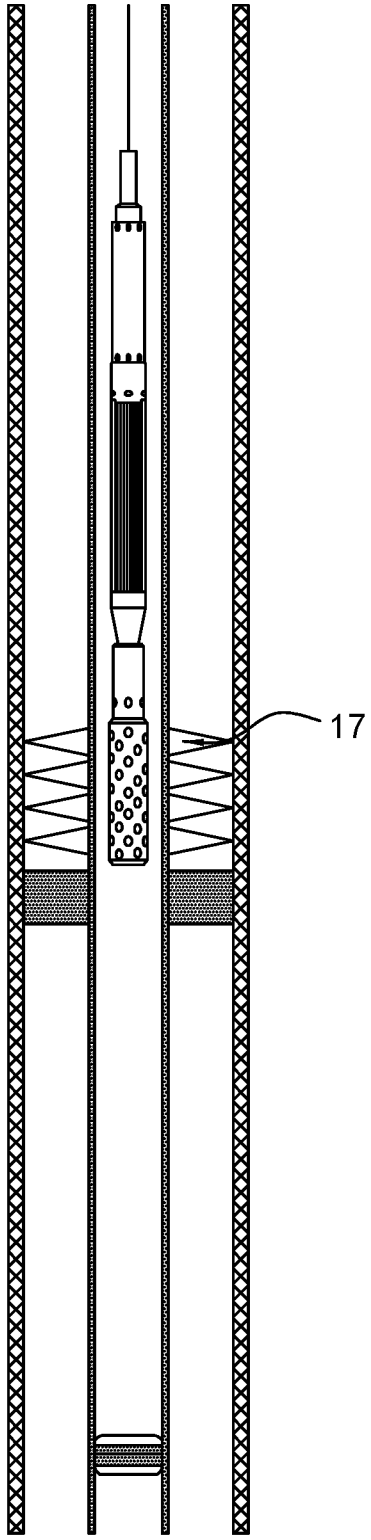
FIG. 4 shows a schematic drawing of a prepared well wherein the plugging tool has been retracted to a region above the production packer and the perforating tool has been fired, thereby perforating the production tubing.

In FIG. 4, the plugging tool 21 has been retracted to a position above the production packer 15 and the perforating tool 12 has made perforations 17 in the tubing 14, providing an opening between the tubing 14 and the annular cavity between the tubing 14 and the casing 13. It should be understood that in a similar manner, casing may also be perforated to access an annular cavity between itself and a further outer string of casing, or formation if no such outer casing is present. Furthermore, the disclosure is not limited in application to a single annular cavity between tubulars and may be applied to one or several annular cavities.

Furthermore, it should also be understood that the cement, formation or other fill of any annular cavity may be sufficiently cracked, broken up or 'crubbelized' by the perforation energy of shaped charges such that a hydraulic conduit can be established along the perforated length of the annular cavity, allowing molten alloy (or liquid sealant) to be displaced into the void spaces in the rubbelized material, and seal the annular cavity. It is also intended that such feature can be integrated into the plugging tool 21 of this disclosure by suitable selection of the perforating charges.

Figure 5:
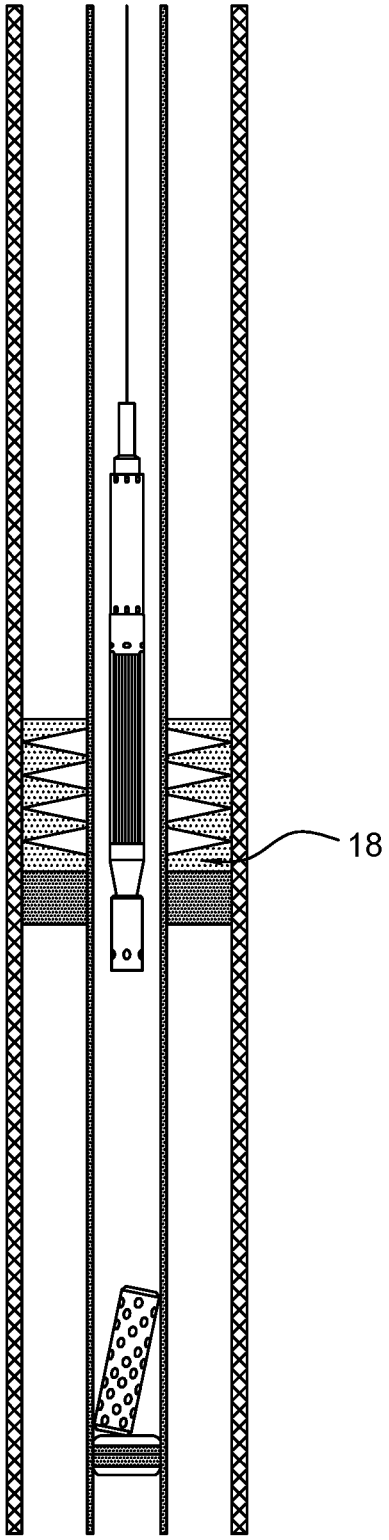
FIG. 5 shows a schematic drawing of a prepared well wherein the plugging tool has released the perforating tool immediately after firing, and the perforating tool has fallen to the sump of the well. The heater inside the hollow mandrel clad with thermally-activated plugging material has been triggered, releasing the plugging material from the mandrel cladding to flow through the perforations and into the production tubing and annulus

In FIG. 5, the perforating tool 12, having been actuated (fired) as shown in FIG. 4, has been released from the disconnect 11 and has dropped to the sump of the well, that is, the portion of the tubing 14 below the production packer 15 and above the bridge plug 16. Meanwhile, the combined hollow mandrel, heater and molten alloy tool (or liquid sealant device) has been triggered and the heater 8 melts the alloy cladding 9 which becomes molten and flows via the perforations and into the annular cavity, filling both the tubing and annular cavity with a volume of molten alloy (or liquid sealant) 18.

Figure 6:
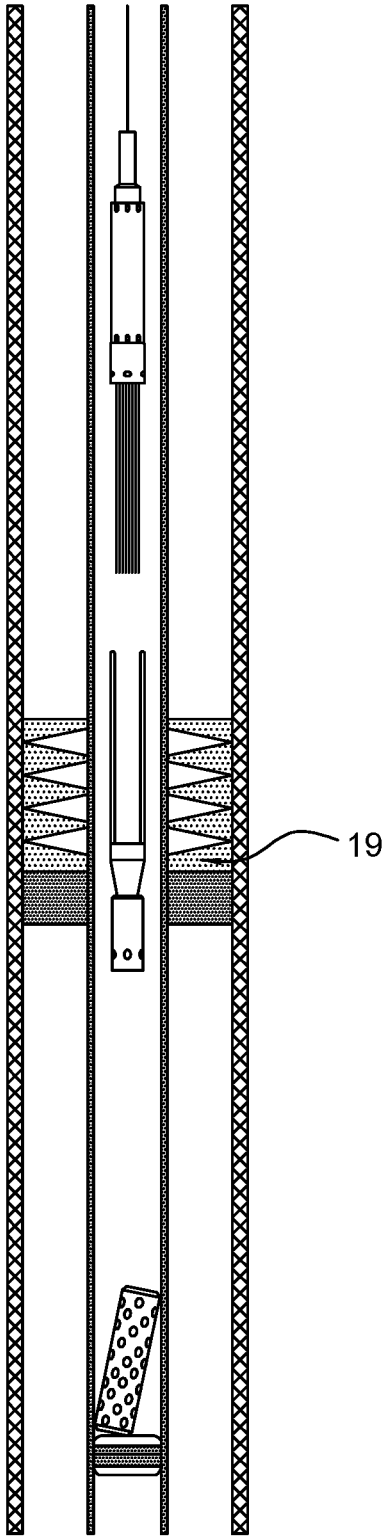
FIG. 6 shows a schematic of a prepared well wherein the upper section of the plugging tool comprising the heater and CCL section has been released from the hollow mandrel and is recovered from the well, leaving the hollow mandrel and lower section of the tool behind and set within the solidified or solidifying thermally activated plugging material. At this point the and production fluids from zones beneath the plug are contained within the well and the well may be considered plugged.

In FIG. 6, the upper section 1 and the heater 8 of the pulling tool 21 has been released from the hollow mandrel 9 and further retracted above, leaving the hollow mandrel 9, skirt 10 and lower perforation section 3 of the tool behind and set within the solidified or solidifying plug of alloy. Hence the casing collar locator and heater may be fully retracted from the well and recovered at surface, allowing the molten alloy to cool and solidify completely. The solidified material forms a solid plug 19 across the full cross section of the wellbore. The wellbore has therefore been fully plugged above the production packer. The plugging tool 21 and method therefore makes it possible to plug a well in only one trip.

Figure 7:
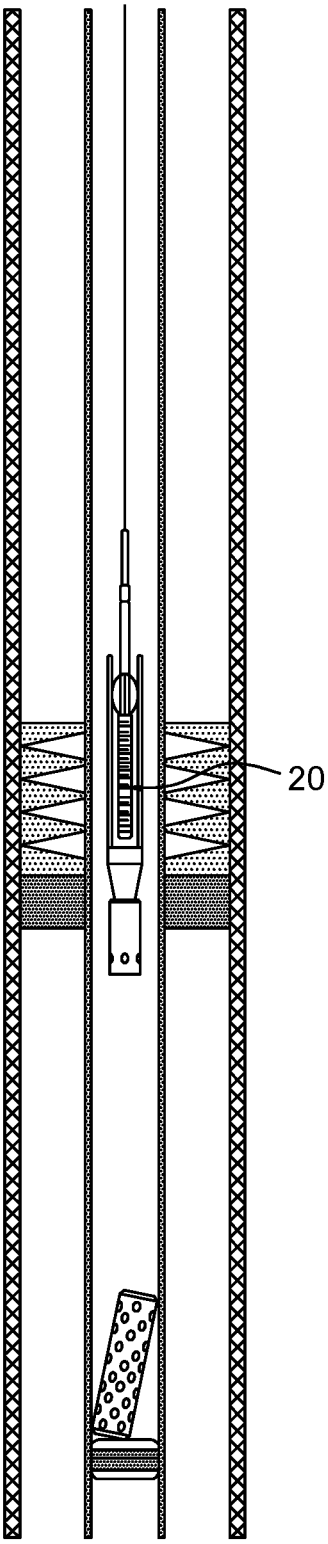
FIG. 7 shows a schematic of a well plugged with the plugging tool wherein the upper section of the tool comprising the heater and CCL section has been recovered to surface and a cement bond logging tool has been subsequently run to inspect and verify the status of the solidified plugging material in the annulus.

In FIG. 7, the upper section 1 and heater 8 of the plugging tool 21 has been fully recovered from the well, and a cement bond logging tool 20 has been subsequently run inside the hollow mandrel 9 to inspect and verify the status of the solidified plugging material in the annulus. The unique hollow mandrel 9 incorporated into the plugging tool 21 design and the method proposed therefore makes it possible to also independently verify the status of the barrier installed in the annulus.

The internal diameter of the mandrel and the outer diameter of the logging tool have been selected so that the logging tool will easily fit inside of the mandrel.

In a preferred embodiment, the logging tool is landed with a shoulder abutting the upper end of the mandrel and one or more transducers are set to move along the logging tool to scan the plug from inside the mandrel. This may be done by rotating a screw within the tool to move the transducers along the length of the plug as well as rotating them to scan the circumference of said plug.

It should be understood that the steps described above are only one example of a method of using the plugging tool 21. Those skilled in the art will understand that the number and sequence of steps depend on the actual case at hand. For example, given the appropriate well conditions, thermal output of the heater and alloy selection, the plugging tool 21 may also be used to place a plug either substantially above or below the production packer, without the need for support of the production packer, or in other parts of the well. Furthermore, in general the plugging tool 21 may be used to place a plug in any tubular or annulus or plug leaks elsewhere in a well (e.g. tubing leaks, packer leaks etc.).

It should be noted, however, that if the plugging operation described above is not successful, for example due to the plugging tool 21 becoming stuck, having triggered either the perforating tool 12, the combined hollow mandrel, heater and molten alloy (or liquid sealant) tool 2, or both, it is possible to release these sections of the plugging tool 21 using the disconnect (11 or 7 in FIG. 1) respectively, and retrieve the section(s) remaining above so that it may be re-fitted with the required new sections below allowing the complete plugging tool 21 to be re-conveyed to a different location in the well, and the procedure repeated.

Furthermore, the cable head 5 may contain a weak point known in the art that will break at a pre-determined tension when applied from surface, should the full plugging tool 21 be stuck in the well and the run is required to be abandoned.

While the invention has been described with reference to an annular cavity between a completion/production tubing and a casing, it should be understood that the invention is equally applicable for installing a plug in a well having multiple casings or tubulars and in an annular cavity between a tubular and formation. Furthermore, a similar method may be used to plug leaks elsewhere in a well or other wellbore components or configurations.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

The invention claimed is:

1. A method for perforating and sealing a well conduit in a single run, the method comprising:

building a tool string comprising a perforating tool and a plugging tool, said perforating tool being arranged at a distal end of said tool string, moving said tool string into said well conduit until said perforating tool is in a first position in said well conduit;

actuating said perforating tool to create a perforated zone of openings in said well conduit;

moving said plugging tool to said first position in the well conduit, said plugging tool comprising a hollow mandrel conveying a thermally activated sealing material on its exterior and a heater on its interior;

operating the plugging tool to activate the thermally activated sealing material disposed on said exterior of said hollow mandrel;

allowing said thermally activated sealing material to solidify in said well conduit to form a plug and to flow into said openings to fill a cross-section of an annular space outside said well conduit;

disconnecting said heater and recover said heater from said hollow mandrel, and subsequently running a logging tool into said hollow mandrel, said logging tool detecting said thermally activated sealing material deposited in said cross-section and said annular space; and disconnecting said perforating tool from said tool string after said creating of said perforated zone has been completed, and letting said perforating tool drop in the well conduit to below said perforated zone.

2. The method of claim 1, wherein the plugging tool comprises a depth correlation device and the moving comprises locating a feature using said depth correlation device.

3. The method of claim 2, wherein said depth correlation device comprises a magnetic casing collar locator.

4. The method of claim 1, wherein said creating of openings comprises actuating explosive shaped charges, mechanical pipe slotting or hole punching, or thermite or chemical cutting or perforating.

5. The method of claim 1, wherein the thermally activated sealing material comprises a metal alloy.

6. The method of claim 1, wherein the operating the heater/thermally activated material tool comprises initiating a pyrotechnic chemical reaction.

7. The method of claim 5, wherein the thermally activated sealing material comprises a fusible metal alloy.

8. The method of claim 7, wherein the fusible metal alloy is a mixture of bismuth and tin.

9. A method for perforating and sealing a well conduit in a single run, the method comprising:

building a tool string comprising a perforating tool and a plugging tool, said perforating tool being arranged at a distal end of said tool string, moving said tool string into said well conduit until said perforating tool is in a first position in said well conduit;

actuating said perforating tool to create a perforated zone of openings in said well conduit;

moving said plugging tool to said first position in the well conduit, said plugging tool comprising a hollow mandrel conveying a thermally activated sealing material on its exterior and a heater on its interior;

operating the heater tool to activate the thermally activated sealing material disposed on said exterior of said hollow mandrel;

allowing said thermally activated sealing material to solidify in said well conduit to form a plug and to flow into said openings to fill a cross-section of an annular space outside said well conduit; and disconnecting said heater and recover said heater from said hollow mandrel and subsequently running a logging tool into said hollow mandrel, said logging tool detecting said thermally activated sealing material deposited in said cross-section and said annular space; and wherein one or more transducers of the logging tool is moved with respect to the mandrel while said logging tool is stationary with respect to the mandrel.

10. The method of claim 9, wherein the plugging tool comprises a depth correlation device and the moving comprises locating a feature using said depth correlation device.

11. The method of claim 10, wherein said depth correlation device comprises a magnetic casing collar locator.

12. The method of claim 9, wherein said creating of openings comprises actuating explosive shaped charges, mechanical pipe slotting or hole punching, or thermite or chemical cutting or perforating.

13. The method of claim 9, wherein the thermally activated sealing material comprises a metal alloy.

14. A tool string comprising a well conduit perforator and a well conduit plugging tool, said well conduit plugging tool further comprising: a hollow mandrel, a heater, said heater being releasably disposed in an interior of said hollow mandrel, a thermally activated plugging material disposed proximate the heater and on an exterior of said a hollow mandrel;

said well conduit perforator being connected at a distal end of said well conduit plugging tool, to be carried by said well conduit plugging tool for conveyance into said well conduit;

an electrical cable connected to said heater to both convey and power said well conduit plugging tool, and also to monitor wellbore temperature and/or pressure and/or fluid flow;

said well conduit perforator being coupled to said well conduit plugging tool via a disconnect mechanism, enabling disconnect of said well conduit perforator after perforations have been completed;

said heater being retrievably coupled to said hollow mandrel; and wherein said hollow mandrel has an internal diameter adapted to receive a logging tool after a plug has been set by said well conduit plugging tool.

15. The tool string of claim 14, wherein the heater comprises a pyrotechnic chemical or an electric heater.

16. The tool string of claim 14, wherein the thermally activated plugging material comprises a fusible metal alloy.

17. The tool string of claim 16, wherein the thermally activated plugging material comprises a mixture of tin and bismuth.

18. The tool string of claim 14, wherein the well conduit perforator comprises an explosive shaped charge perforator, mechanical pipe slotting or hole punching, or thermite or chemical cutting or perforating device.

19. The tool string of claim 14, wherein the well conduit perforator comprises an explosive shaped charge perforator capable of 'rubbelising' annular cement or annular fill material.

20. The tool string of claim 14, wherein the well conduit perforator comprises an explosive shaped charge perforator capable of perforating inner strings of well conduit tubulars, or first and second string of concentric well conduit tubulars, without damaging a next concentric string of well conduit tubulars.

* * * * *